US012674595B2

(12) United States Patent
Leffler

(10) Patent No.: US 12,674,595 B2
(45) Date of Patent: Jul. 7, 2026

(54) SYSTEMS AND METHODS FOR ACTIVE FAULT DETECTION IN HVAC SYSTEMS

(71) Applicant: Carrier Corporation, Palm Beach Gardens, FL (US)

(72) Inventor: Robert Leffler, Portland, ME (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 425 days.

(21) Appl. No.: 18/344,919

(22) Filed: Jun. 30, 2023

(65) Prior Publication Data

US 2024/0003566 A1 Jan. 4, 2024

Related U.S. Application Data

(60) Provisional application No. 63/367,366, filed on Jun. 30, 2022.

(51) Int. Cl.

| | |
|---|---|
| ***F24F 11/38*** | (2018.01) |
| ***F24F 11/32*** | (2018.01) |
| *F24F 110/00* | (2018.01) |

(52) U.S. Cl.

CPC ..... *F24F 11/38* (2018.01); *F24F 11/32* (2018.01); *F24F 2110/00* (2018.01)

(58) Field of Classification Search

CPC ..... F24F 11/38; F24F 11/32; F24F 2110/00
See application file for complete search history.

(56) References Cited

U.S. PATENT DOCUMENTS

| | | | |
|---|---|---|---|
| 6,532,433 | B2 | 3/2003 | Bharadwaj et al. |
| 7,117,125 | B2 | 10/2006 | Dimino et al. |
| 7,496,472 | B2 | 2/2009 | Seem |
| 7,814,034 | B2 | 10/2010 | Eklund et al. |
| 9,223,667 | B2 | 12/2015 | Sanford et al. |
| 9,366,451 | B2 | 6/2016 | Guo et al. |
| 9,513,043 | B2 | 12/2016 | Keres et al. |
| 9,696,073 | B2 | 7/2017 | Noboa et al. |
| 9,709,980 | B2 | 7/2017 | Bonissone et al. |

(Continued)

FOREIGN PATENT DOCUMENTS

| | | |
|---|---|---|
| EP | 3444724 A1 | 2/2019 |
| EP | 3889716 A1 | 10/2021 |

(Continued)

*Primary Examiner* — Michael W Choi
(74) *Attorney, Agent, or Firm* — Souad Hakim

(57) ABSTRACT

An active fault detection system for a heating, ventilation, and air conditioning system is disclosed. In some embodiments, the system comprises at least one processor; and memory storing instructions, when executed cause the system to: obtain system data related to operation of one or more components of the HVAC system; determine a fault probability based on the system data, the fault probability indicating a probability of a fault in the HVAC system; send a control signal to a component of the HVAC system to modify one or more control parameters of the component responsive to the fault probability being within a fault threshold range, the threshold range having an upper and lower threshold values; update the determined fault probability based on updated system data resulting from modifying the one or more control parameters; and generate a service schedule responsive to the updated fault probability being above the upper threshold value.

19 Claims, 5 Drawing Sheets

(56) References Cited

U.S. PATENT DOCUMENTS

| | | | |
|---|---|---|---|
| 9,728,014 | B2 | 8/2017 | Khalaschi et al. |
| 9,778,639 | B2 | 10/2017 | Boettcher et al. |
| 9,824,060 | B2 | 11/2017 | Yacout et al. |
| 9,959,158 | B2 | 5/2018 | Kolandavelu et al. |
| 9,977,409 | B2 | 5/2018 | Giering et al. |
| 10,037,026 | B2 | 7/2018 | Shinkle et al. |
| 10,113,552 | B2 | 10/2018 | Zhang et al. |
| 10,317,853 | B2 | 6/2019 | Inagaki et al. |
| 10,372,567 | B2 | 8/2019 | Rensing et al. |
| 10,592,821 | B2 | 3/2020 | Denton et al. |
| 10,941,956 | B2 | 3/2021 | Gao et al. |
| 10,969,775 | B2 | 4/2021 | Khalate et al. |
| 10,989,427 | B2 | 4/2021 | Maslekar et al. |
| 11,070,389 | B2 | 7/2021 | Schuster et al. |
| 11,099,551 | B2 | 8/2021 | Ristovski et al. |
| 11,100,788 | B2 | 8/2021 | Horgan et al. |
| 11,187,446 | B2 | 11/2021 | Brady et al. |
| 11,220,999 | B1 | 1/2022 | Cheng |
| 11,222,202 | B2 | 1/2022 | Kean et al. |
| 11,232,368 | B2 | 1/2022 | Tashman et al. |
| 11,262,743 | B2 | 3/2022 | Shetty et al. |
| 11,281,201 | B2 | 3/2022 | Williams |
| 2008/0240931 | A1 | 10/2008 | Kallesoe |
| 2009/0274565 | A1 | 11/2009 | White |
| 2011/0178977 | A1* | 7/2011 | Drees ..... G06Q 10/04 706/52 |
| 2016/0055044 | A1 | 2/2016 | Kawai et al. |
| 2016/0370026 | A1 | 12/2016 | Denton et al. |
| 2017/0293862 | A1 | 10/2017 | Kamiya et al. |
| 2018/0087790 | A1 | 3/2018 | Perez |
| 2019/0107304 | A1* | 4/2019 | Blair ..... F24F 11/38 |
| 2019/0264936 | A1* | 8/2019 | Bailey ..... F24F 11/65 |
| 2019/0391573 | A1 | 12/2019 | Wang |
| 2020/0067789 | A1 | 2/2020 | Khuti et al. |
| 2021/0096557 | A1 | 4/2021 | Shelar et al. |
| 2021/0207827 | A1 | 7/2021 | Rowswell et al. |
| 2021/0262689 | A1 | 8/2021 | Shinde et al. |
| 2021/0355857 | A1 | 11/2021 | Zeng et al. |
| 2022/0057766 | A1 | 2/2022 | Cao et al. |
| 2022/0058497 | A1 | 2/2022 | Vazquez-Canteli et al. |

FOREIGN PATENT DOCUMENTS

| | | | | |
|---|---|---|---|---|
| WO | WO-2020078141 | A1 * | 4/2020 | ..... G05B 23/0262 |
| WO | 2021142694 | A1 | 7/2021 | |
| WO | 2021171156 | A1 | 9/2021 | |
| WO | 2021179250 | A1 | 9/2021 | |
| WO | 2021202119 | A1 | 10/2021 | |

* cited by examiner

SYSTEMS AND METHODS FOR ACTIVE FAULT DETECTION IN HVAC SYSTEMS

CROSS REFERENCE TO A RELATED APPLICATION

The application claims the benefit of U.S. Provisional Application No. 63/367,366 filed Jun. 30, 2022, the contents of which are hereby incorporated in their entirety.

BACKGROUND

The invention relates generally to fault detection in heating, ventilation, and air conditioning (HVAC) systems and, more specifically, to active fault detection in HVAC systems.

Fault detection and diagnostics methods for HVAC systems are generally used to passively observe the system, compare the gathered information with pre-set values, and classify the system as faulty or normal. Using these passive fault detection methods may result in false negatives or false positive in some cases.

BRIEF DESCRIPTION

Aspects of the disclosure relate to methods, apparatuses, and/or systems for active fault detection in HVAC systems.

In some embodiments, an active fault detection system, for a heating, ventilation, and air conditioning (HVAC) system, comprises at least one processor; and memory storing instructions executable by the at least one processor, the instructions when executed cause the system to: obtain system data related to operation of one or more components of the HVAC system; determine a fault probability based on the system data, the fault probability indicating a probability of a fault in the HVAC system; send a control signal to a component of the HVAC system to modify one or more control parameters of the component responsive to the fault probability being within a fault threshold range, the threshold range having an upper and lower threshold values; update the determined fault probability based on updated system data resulting from modifying the one or more control parameters; and generate a service schedule responsive to the updated fault probability being above the upper threshold value.

In some embodiments, the active fault detection system further comprises one or more sensors configured to generate output signals related to the operation of one or more components of the HVAC system, and wherein the instructions further cause the system to determine the system data based on the output signals.

In some embodiments, the instructions further cause the system to identify the component of the HVAC based on the system data; and determine the one or more control parameters to modify based on the system data.

In some embodiments, modifying the one or more control parameters of the component is temporary, and wherein the instructions further cause the system to return the one or more control parameters to a pre-modification state.

In some embodiments, the instructions further cause the system to determine a control action to resolve the fault; and apply the control action to the HVAC system, and/or include the control action in the generated service schedule.

In some embodiments, the HVAC system comprises a thermostat, and wherein the thermostat comprises the at least one processor and the memory storing instructions.

In some embodiments, a method for active fault detection in a heating, ventilation, and air conditioning (HVAC) system, is implemented in a system comprising at least one processor, and memory storing instructions. The method comprises: obtaining system data related to operation of one or more components of the HVAC system; determining a fault probability based on the system data, the fault probability indicating a probability of a fault in the HVAC system; sending a control signal to a component of the HVAC system to modify one or more control parameters of the component responsive to the fault probability being within a fault threshold range, the threshold range having an upper and lower threshold values; updating the determined fault probability based on updated system data resulting from modifying the one or more control parameters; and generating a service schedule responsive to the updated fault probability being above the upper threshold value.

In some embodiments, a non-transitory computer-readable storage medium storing program instructions computer-executable to implement: obtaining system data related to operation of one or more components of a heating, ventilation, and air conditioning (HVAC) system; determining a fault probability based on the system data, the fault probability indicating a probability of a fault in the HVAC system; sending a control signal to a component of the HVAC system to modify one or more control parameters of the component responsive to the fault probability being within a fault threshold range, the threshold range having an upper and lower threshold values; updating the determined fault probability based on updated system data resulting from modifying the one or more control parameters; and generating a service schedule responsive to the updated fault probability being above the upper threshold value.

Various other aspects, features, and advantages of the invention will be apparent through the detailed description of the invention and the drawings attached hereto. It is also to be understood that both the foregoing general description and the following detailed description are examples and not restrictive of the scope of the invention.

DETAILED DESCRIPTION

In the following description, for the purposes of explanation, numerous specific details are set forth in order to provide a thorough understanding of the embodiments of the invention. It will be appreciated, however, by those having skill in the art that the embodiments of the invention may be practiced without these specific details or with an equivalent arrangement. In other cases, well-known structures and devices are shown in block diagram form in order to avoid unnecessarily obscuring the embodiments of the invention.

Some passive fault detection methods may set a probability decision boundary. When a probability is higher than the decision boundary the behavior is classified as faulty, and when the probability is lower it is classified as normal. False positives and false negatives often happen when predicted probability is near the decision boundary. This may lead to false alarms, dispatching technician when there no real need, and/or missing faults. The present disclosure, in accordance with some embodiments, describes a system 100 for active fault detection in a heating, ventilation, and air conditioning (HVAC) system. In some embodiments, system 100 may be configured to obtain data related to performance of one or more equipment of the HVAC system. Performance data may be compared to data from normal and/or faulty systems to determine a probability of presence of a fault. In response to the probability being within a probability threshold, system 100 may be configured to control one or more system variables to make the fault more observable. The active fault detection may help eliminate (or at least reduce) false prediction through amplifying the faulty system behavior temporarily. This may also help identify faults early.

Figure 1:
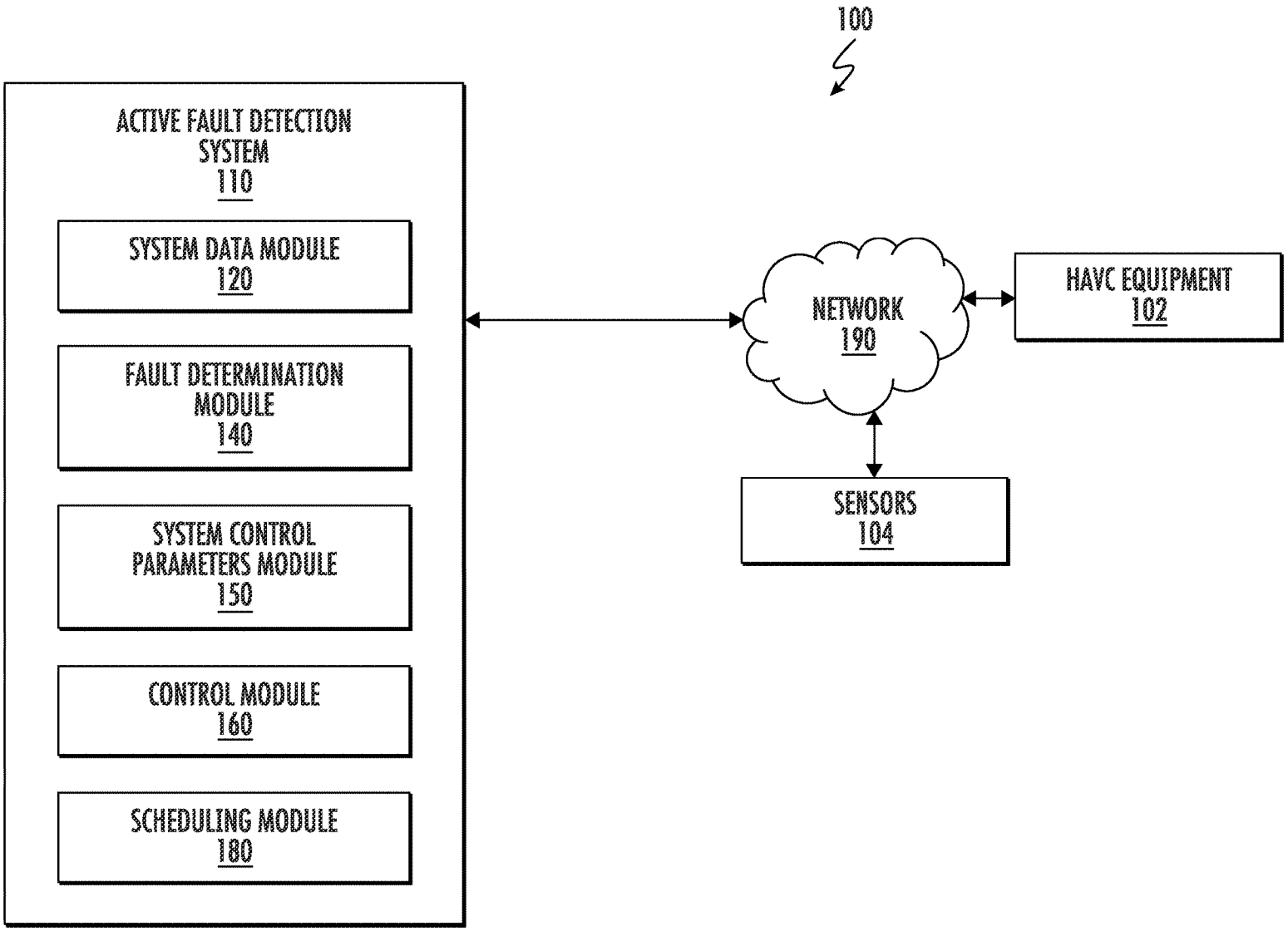
FIG. 1 shows an example of an active fault detection in HVAC systems, in accordance with one or more embodiments.

FIG. 1 shows a system 100 for determining equipment failure in a HVAC system, in accordance with one or more embodiments. In some embodiments, system 100 may include an active fault detection system 110, HVAC system 102, sensors 104, and/or other components. System 100 may further include other components that perform or assist in the performance of one or more processes that are consistent with disclosed embodiments. In addition, other components known to one of ordinary skill in the art may be included in system 100 to gather, process, transmit, receive, acquire, and provide information used in conjunction with the disclosed embodiments.

HVAC system 102 may be configured to control environment of a space (e.g., residential and/or commercial space). In some embodiments, the environmental variables controlled by HVAC system 102 may include one or more of temperature, pressure, flow rates, humidity, and/or other environment related variables. In some embodiments, HVAC system 102 may include one or more components (e.g., indoor units, outdoor units, controllers, thermostats, etc.). For example, HVAC system 102 may include one or more compressors, heat exchangers, evaporators, condensers, chillers, pumps, dampers, outdoor fans, indoor fans, air ducts, control valves, sensors, and/or other components.

Sensors 104 may be configured to generate output signals related to information (data) related to the operation, performance, and/or status of the one or more components of HVAC system 102. In some embodiments, sensors 104 may be independent of the HVAC system components (e.g., located within or outside system 100) and configured to be in communication with the HVAC system components. For example, sensors 104 may include steady-state sensors, and/or transient state sensors. In some embodiments, sensors 104 may include one or more of temperature sensors, pressure sensors, humidity sensors, air flow sensors, air quality sensors, fluid flow sensors, position sensors, gas concentration sensors, optical sensors, accelerometers, gyroscopes, or other sensors for obtaining information related to the functioning or performance the components of HVAC system 102.

Figure 5:
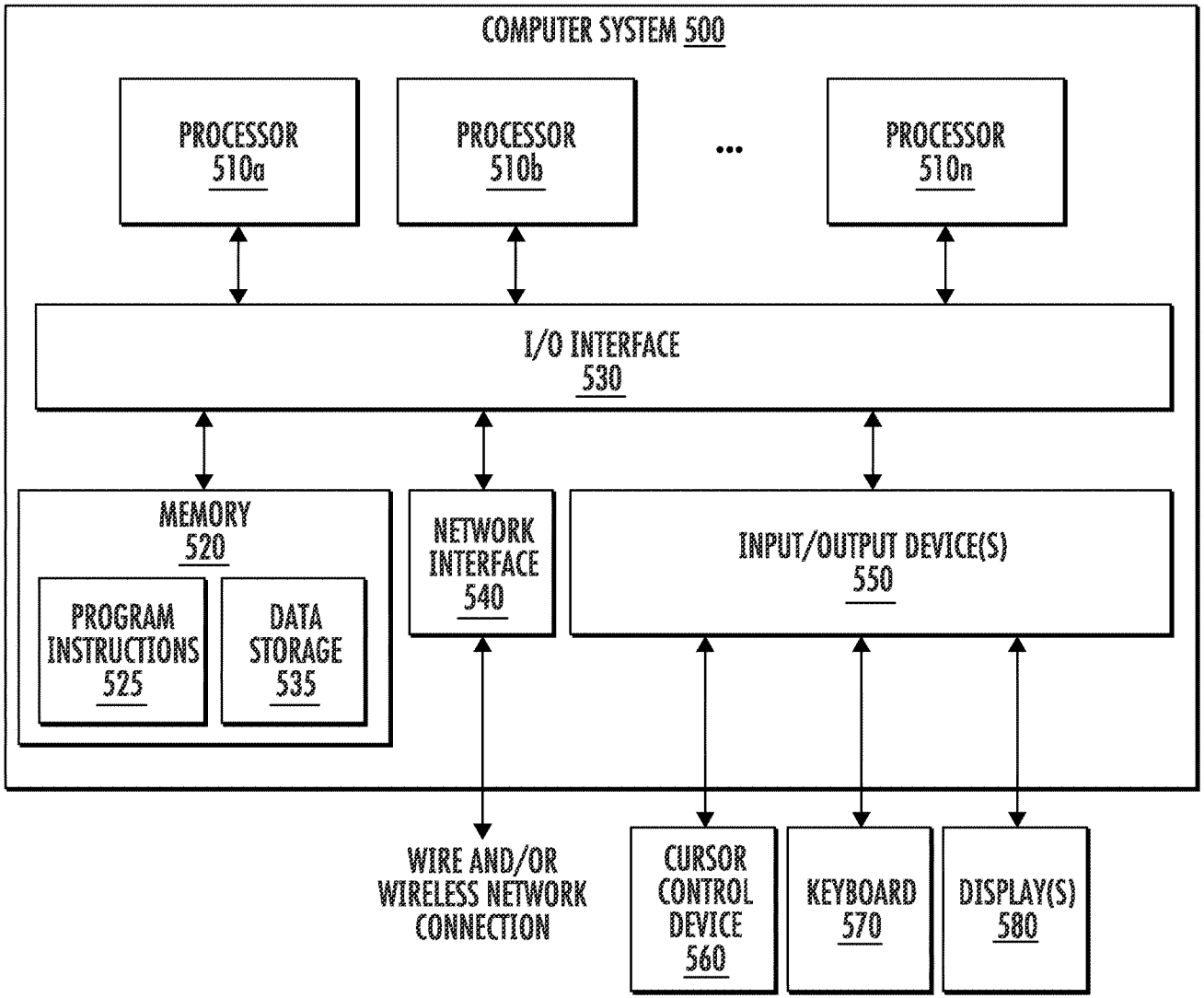
FIG. 5 shows an example of a computer system that may be used to implement aspects of the techniques described herein.

Active fault detection system 110 may include system data module 120, fault classifier module 140, control parameters module 150, control module 160, scheduling module 180, and/or other components. In some embodiments, active fault detection system 110 may include computing resources such as processors and memory devices for storing instructions (e.g., computing system 500 described herein below with reference to FIG. 5). The processors may be configured to execute software instructions to perform various operations of system 100. The computing resources may include software instructions to perform operations of modules 110, 120, 140, 150, 160, 180 and/or other components of system 100. In some embodiments, active fault detection system 110 may be implemented in a controller for the HVAC system 102 (e.g., a thermostat), in a building management system, or in a stand-alone controller for controlling one or more components of HVAC system 102.

System data module 120 may be configured to obtain system data. In some embodiments, the system data may include system status data, mode data, performance data, and/or other data related to operations of one or more components of HVAC system 102. In some embodiments, the system data may include one or more of system load data (e.g., operating in part or full load), speed data (e.g., of fans, compressors, pumps, etc.), component status data (e.g., status of fans, compressors, chillers, pumps, condensers, evaporators, dampers, etc.), controller signals (e.g., valve positions, damper positions, setpoints data, etc.), pressure (e.g., discharge or suction), temperature (e.g., subcooling, suction, discharge, log-mean temperature difference (LMTD), etc.), flow rate and/or other system data. In some embodiments, system data may be obtained from sensors 104, one or more controllers (e.g., HVAC controllers, component controllers, thermostat, and/or building management system controllers).

Fault determination module 140 may be configured to detect a system fault (e.g., a fault in one or more components of HVAC system 102) based on the obtained system data. In some embodiments, additional information may be used in the fault detection operation. For example, the additional information may include environmental information (e.g., outside and/or inside temperature, pressure, humidity), occupancy information, energy consumption/need information, system data from similar HVAC systems, historical data (from HVAC system 102 or similar systems), and/or other additional information that can be used in detecting (or predicting) fault. In some embodiments, fault determination module 140 may include one or more active fault determination and diagnostic models (FDD models) configured for predicting a system fault based on the system data. For example, the active FDD models may determine a fault probability based on the obtained system data.

In some embodiments, determination module 140 may include a machine learning system for training one or more machine learning models (e.g., active FDD models) to determine/predict a fault probability. In some embodiments, the machine learning system may include predictive models configured to determine the fault probability. In some embodiments, the predictive models may use one or more data samples (current or historical) to determine the fault probability (e.g., system data obtained from module 120, or other information received from other components within or outside system 100). In some embodiments, the machine learning system may be configured to use one or more of supervised learning, semi-supervised, unsupervised learning, reinforcement learning, and/or other machine learning techniques. In some embodiments, the machine learning models may include decision trees, support vector machines, nearest neighbors' models, autoregression analysis, Bayesian networks, random forest learning, dimensionality reduction algorithms, boosting algorithms, artificial neural networks (e.g., fully connected neural networks, deep convolutional neural networks, or recurrent neural networks), deep learning, and/or other machine learning models. It is to be noted that the examples of machine learning models described herein are not intended to be limiting, other machine learning models may be used and are consistent with the present disclosure.

Figure 2:
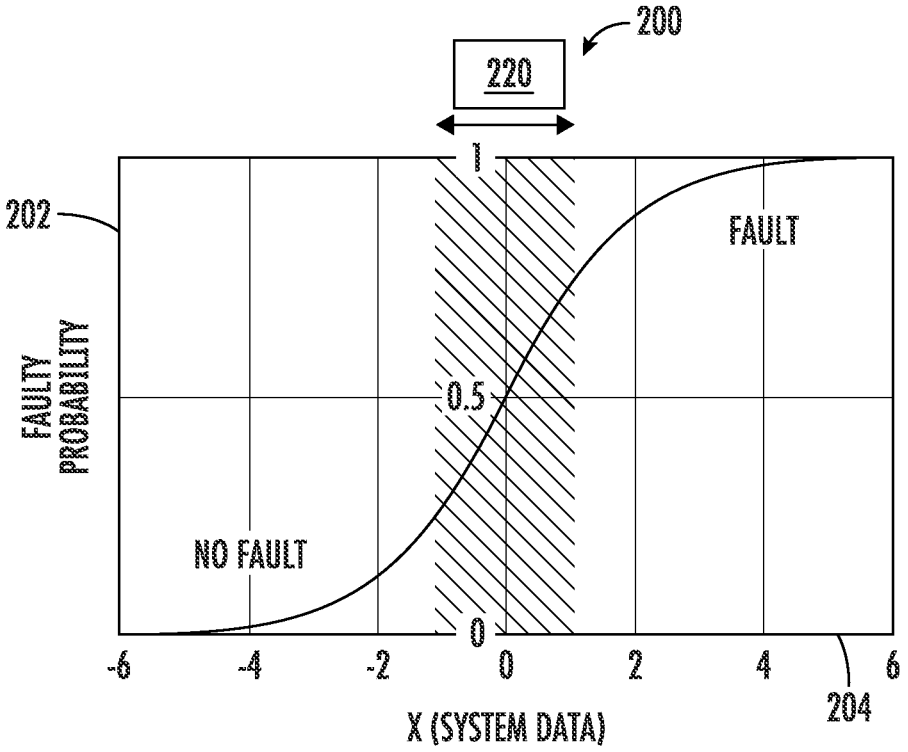
FIG. 2 shows an example shows an exemplary fault probability graph, in accordance with one or more embodiments.

The fault probability may indicate whether a component of HVAC system 102 is faulty or normal based on the probability value. For example, a component may be determined to be faulty responsive to a fault probability for the component being above an upper probability threshold. Alternatively, a component may be determined to be normal responsive to a fault probability for the component being below a lower probability threshold. FIG. 2, shows an exemplary fault probability graph 200, according to one or more embodiments. Graph 200 represents fault probability 202 over system data 204. In this example, a component may be determined to be faulty if the fault probability is above 50% and determined to be normal if the fault probability is below 50%. However, in cases, where the fault probability is close to the threshold (e.g., within a threshold zone), active fault detection system 110 may be configured to modify one or more control parameters to make the fault more observable (as described below). In some embodiments, the threshold zone 220 may be between about of −20 and +20 of the 50% probability (e.g., between a lower probability threshold of 30% and an upper probability threshold 70%). In some embodiments, fault determination module 140 may be configured to determine the threshold range (or zone) based on the type of fault, the potentially faulty component, the system data, the HVAC system, system load, and/or other information.

Control parameters module 150 may be configured to identify system control parameters that may affect the fault probability (e.g., amplify, reduce, or no effect). In some embodiments, control parameters module 150 may identify system controls, that when modified, the probability may move away from the fault threshold range. For example, the confirm the fault, reject the fault as a false positive, or reject a false negative. For example, in some embodiments, the system control parameters (identified by control parameters module 150) may include one or more of compressor related controls (e.g., speed or active stages), fan control (e.g., speed), EXV controls (e.g., degrees of opening of expansion valves), hot-gas bypass controls, suction modulation valve controls, and/or other system control parameters. In some embodiments, control parameters module 150 may be configured to determine the modification to be applied to the control parameters. In some embodiments, determining the modification may be determined based on the system data (e.g., system status, type of fault, the potentially faulty component, and/or system data). For example, control parameters module 150 may determine modification to the compressor controls (e.g., whether to increase or decrease speed of the compressor, the amount by which it should be increased or decreased, and/or the length of the modification). Similarly, or alternatively, modification to other system control parameters, the amount and/or the length of modification may be determined by control parameters module 150 (e.g., indoor fan speed, outdoor fan speed, control valves opening, and/or other determined system control parameters).

Control module 160 may be configured to send one or more control signals to modify one or more system control parameters based on the fault probability being within a fault threshold range, the threshold range having an upper and lower threshold values. In some embodiments, the control module may send the output signals to one or more components based on information received from control parameters module 150 (e.g., the identified system controls, and/or the modification to be applied to the system controls). In some embodiments, the control signal may be sent to a controller for the HVAC system, or directly to one or more components of the HVAC system (e.g., compressor, outdoor/indoor fans, EXVs, etc.) In some embodiments, control module 160 may be configured to change the control parameters back to pre-modification status. In other words, control module 160 may modify the control parameters temporarily to observe the behavior of the system (e.g., to amplify the fault probability) and return the parameters to their initial state.

In some embodiments, system data module 120 may be configured to obtain updated system data during and/or after the control parameters modification. The updated system data resulting from the modification may be used by fault determination module 140 to update the fault probability. In some embodiments, updating the fault probability may move the fault probability from the fault threshold zone. For example, the probability of a fault may increase (above the upper fault probability threshold), in these cases the fault determination module 140 may classify performance of the system as faulty. In other cases, the probability of a fault may decrease (below the lower fault probability threshold), in these cases the fault determination module 140 may classify performance of the system as normal.

In some embodiments, responsive to the fault probability being above the upper probability threshold, control module 160 may be configured to send an alarm control signal. The alarm control signal indicating a fault occurrence. In some embodiments, the alarm may be audible, visual, graphical, textual, etc. Control module 160 may be configured to send a control signal to display the alarm on a display (of a controller, thermostat, or a user device, of computing system 500 described herein).

Scheduling module 180 may be configured to generate an intervention schedule based on the updated fault probability. In some embodiments, the intervention schedule may indicate the faulty HVAC equipment and/or the type of service needed. The intervention (type of service) may be configured to prevent, delay, or correct the fault. In some embodiments, in response to fault determination module 140 classifying performance of the system as faulty, system control parameters module 150 may be configured to determine one or more control actions to prevent, delay, or correct the fault. Control module 160 may send one or more control signals based on the determined control actions to one or more components of the HVAC system (e.g., the faulty components and/or other components). In other words, system 100 (e.g., module 150) may be configured to determine if it can correct the fault. If system 100 determines that it can correct the fault, system control parameters 150 may determine the corrective action. Control module 160 may send control signals to apply the determined corrective action. In cases, where system 100 determines that it can't correct the fault, scheduling module 180 generates the intervention schedule.

In operation, for example, fault determination module 140 may determine a probability of fault in an evaporator (e.g., partial log) based on capacity data being slightly less than expected. In response to the probability of the fault being within a probability threshold range (e.g., 42%, i.e., less than 50%), and the system status indicating operation in part-load, control parameters 150 may identify compressor speed, as a control parameter that when modified may amplify the fault observability. Control module 160 may be configured to increase compressor speed temporarily to raise capacity, improve distribution, and make the fault easier to detect. For example, in response to modifying the compressor speed, the capacity is still not at the expected level, and the fault probability is updated based on the new system data and reaches 93%. A fault alarm may be raised, and a service schedule may be generated based on the updated probability.

In another example, fault determination module 140 may determine a probability of charge loss based on performance data indicating a slightly low subcooling and suction temperature. In response to the probability of charge loss being within a probability threshold range (e.g., between about 40% and 60%), and the system status indicating operation in part-load, control parameters 150 may identify compressor speed, indoor fan, and/or outdoor fan speed as control parameters that may amplify the fault observability. Control module 160 may be configured to increase compressor and fan speed to increase capacity and observe subcooling and suction temperature.

In yet another example, fault determination module 140 may determine a probability of condenser fouling based on performance data indicating an elevated log-mean temperature difference (LMTD). In response to the probability of condenser fault being within a probability threshold, and the system status indicating operation in part-load, control parameters 150 may identify compressor speed, indoor fan, and/or outdoor fan speed as control parameters that may amplify the fault observability. Control module 160 may be configured to increase compressor and/or fan speed to increase capacity and LMTD.

In another example, fault determination module 140 may determine a probability of a pressure sensor fault (e.g., stuck/frozen) based on data obtained from a discharge pressure sensor. In response to the probability of pressure fault being within a probability threshold, and the system status indicating operation in full-load, control parameters 150 may identify outdoor fan speed as a control parameter that may amplify the fault observability. Control module 160 may be configured to decrease outdoor fan speed to see if sensor reading increases.

In yet another example, fault determination module 140 may determine a probability of an evaporator fault (e.g., frozen/icing) based on performance data indicating an elevated LMTD. In response to the probability of the evaporator fault being within a probability threshold, and the system status indicating operation in full-load, control parameters 150 may identify degrees of opening of an EXV as a control parameter that may amplify the fault observability. Control module 160 may be configured to slightly close and then re-open the EXV to observe transient changes in superheat.

Figure 3:
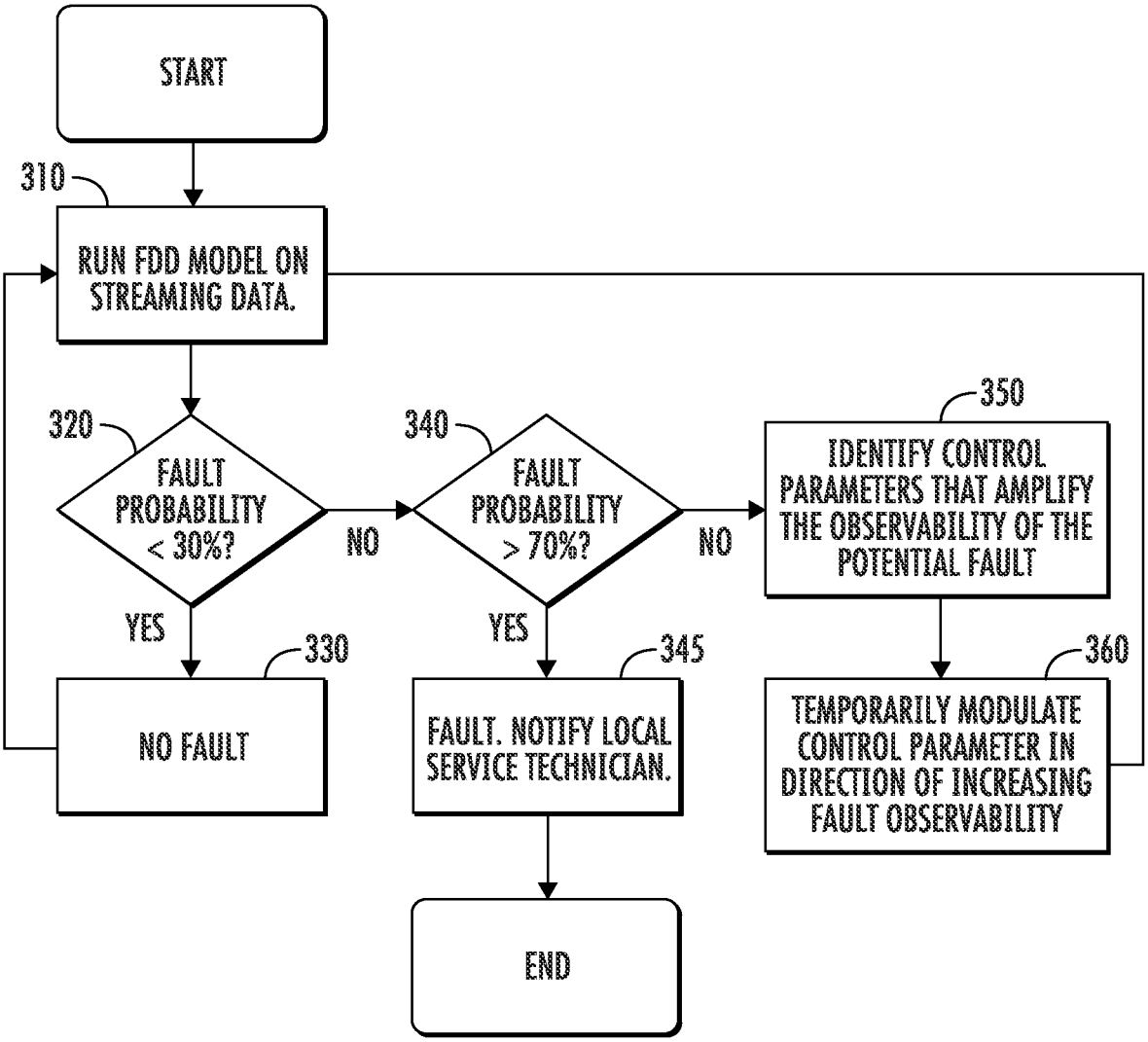
FIG. 3 shows a flow diagram illustrating a method for active fault detection in an HVAC system, in accordance with one or more embodiments.

FIG. 3 shows a flowchart of an exemplary operation of system 100, according to one or more embodiments. At step 310, system data may be input into a FDD model to determine a fault probability. At step 320, a fault probability may be determined based on the system data. Responsive to the probability being outside of a probability threshold zone and below a lower threshold value (in this example 30%), at step 330 the fault determination module may classify the system as normal (no fault). At step 340, responsive to the probability being above the lower fault threshold, the system determines whether the fault probability is above an upper fault (in this example 70%). If the probability is above the upper fault threshold, the fault determination module determines presence of a fault at step threshold step 345. In some embodiments, the system may generate a service schedule to address the fault. If the probability is below the upper threshold, at step 350 the system identifies control parameters that may amplify the observability of the potential fault. At step 360, the system temporarily modulates the control parameters (e.g., in a direction of increasing fault observability). The system data resulting for the control parameters modification are input back in the active FDD model to determine a fault probability.

In some embodiments, one or more components of system 100 may communicate directly through one or more dedicated communication links. In some embodiments system 100 may include a network 190 connecting one or more components of system 100. In some embodiments, network 190 may be any type of network configured to provide communications between components of system 100. For example, network may be any type of wired or wireless network (including infrastructure) that provides communications, exchanges information, and/or facilitates the exchange of information, such as the Internet, near field communication (NFC), optical code scanner, cellular network, a public switched telephone network ("PSTN"), text messaging systems (e.g., SMS, MMS), frequency (RF) link, Bluetooth®, Wi-Fi, a private data network, a virtual private network, a Wi-Fi network, a LAN or WAN network, or other suitable connections that enables the sending and receiving of information between the components of system 100. It will be appreciated that this is not intended to be limiting and that the scope of this disclosure includes implementations in which the client one or more components of system 100 are operatively linked via some other communication media.

It should be appreciated that the illustrated components are depicted as discrete functional blocks, but embodiments are not limited to systems in which the functionality described herein is organized as illustrated. The functionality provided by each of the components may be provided by software or hardware modules that are differently organized than is presently depicted, for example such software or hardware may be intermingled, conjoined, replicated, broken up, distributed (e.g., within a data center or geographically), or otherwise differently organized. The functionality described herein may be provided by one or more processors of one or more computers executing code stored on a tangible, non-transitory, machine readable medium.

Figure 4:
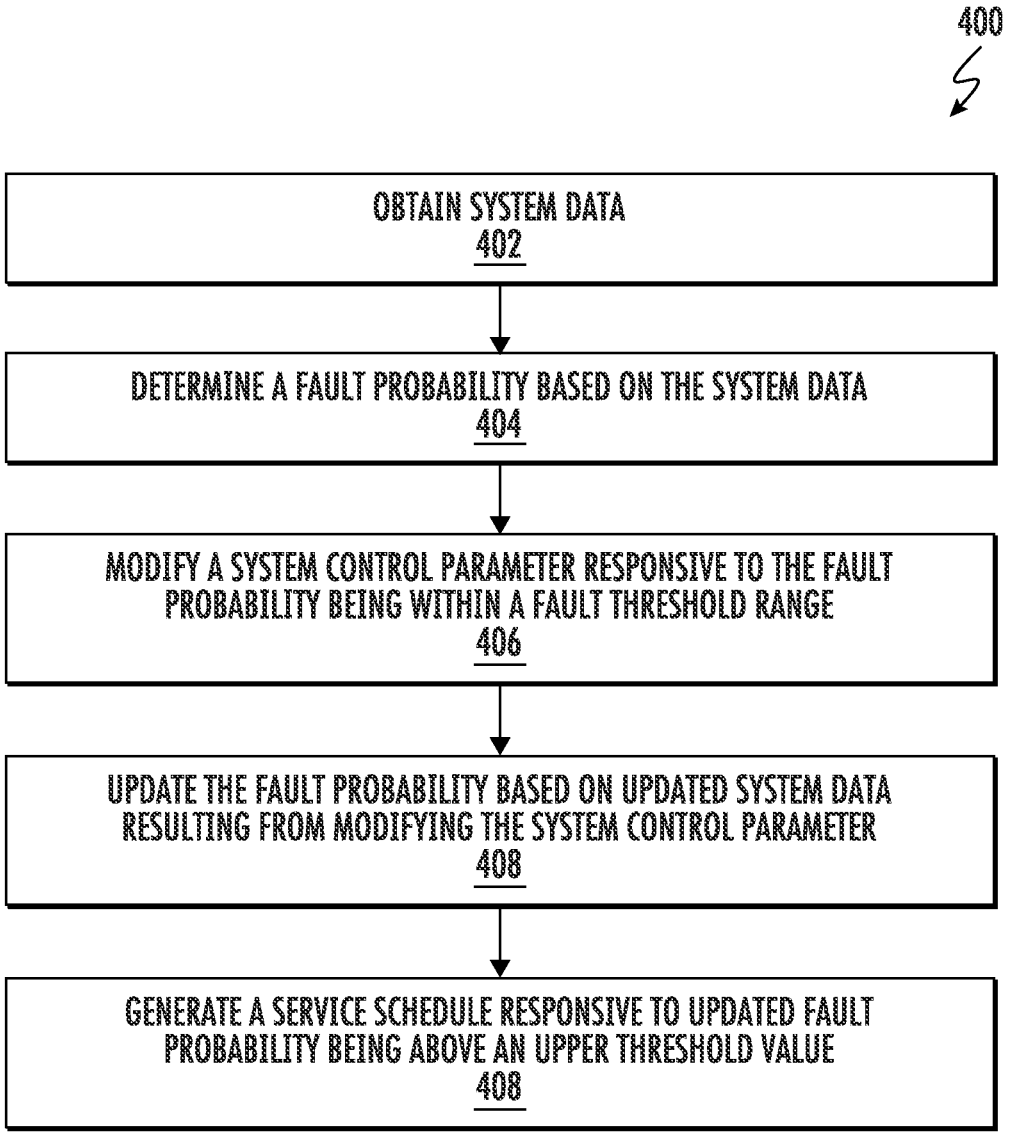
FIG. 4 shows a flow diagram illustrating a method for active fault detection in HVAC systems, in accordance with one or more embodiments.

FIG. 4 illustrates a method 400 for active fault determination, in accordance with one or more embodiments of the present disclosure. The operations of method 400 presented below are intended to be illustrative. In some implementations, method 400 may be accomplished with one or more additional operations not described and/or without one or more of the operations discussed. Additionally, the order in which the operations of method 400 are illustrated in FIG. 4 and described below is not intended to be limiting.

In some embodiments, the methods may be implemented in one or more processing devices (e.g., a digital processor, an analog processor, a digital circuit designed to process information, an analog circuit designed to process information, a state machine, and/or other mechanisms for electronically processing information). The processing devices may include one or more devices executing some or all of the operations of the methods in response to instructions stored electronically on an electronic storage medium. The processing devices may include one or more devices configured through hardware, firmware, and/or software to be specifically designed for execution of one or more of the operations of the method.

At an operation 402 of method 400, system data may be obtained. In some embodiments, operation 402 may be performed by a system data module the same as or similar to system data 120 (shown in FIG. 1 and described herein).

At an operation 404 of method 400, a fault probability may be determined based on the system data. In some embodiments, operation 404 may be performed by a faut determination module the same as or similar to faut determination module 140 (shown in FIG. 1 and described herein).

At an operation 406 of method 400, a system control parameter may be modified responsive to the fault probability being within a fault threshold range. The fault threshold range may include an upper threshold value. In some embodiments, operation 406 may be performed by a control module the same as or similar to control module 160 (shown in FIG. 1 and described herein).

At an operation 408 of method 400, the fault probability may be updated based on updated system data resulting from modifying the system control parameter. In some embodiments, operation 408 may be performed by a module the same as or similar to faut determination module 140 (shown in FIG. 1 and described herein).

At an operation 410 of method 400, a service schedule may be generated responsive to the updated fault probability being above the upper threshold value. In some embodiments, operation 410 may be performed by a scheduling module the same as or similar to scheduling module 180 (shown in FIG. 1 and described herein).

Embodiments of one or more techniques of the present disclosure as described herein may be executed on one or more computer systems, which may interact with various other devices. One such computer system 400 is illustrated by FIG. 4 shows an example of a computer system that may be used to implement aspects of the techniques described herein. In different embodiments, computer system 400 may include any combination of hardware or software that can perform the indicated functions, including, but not limited to, a computer, personal computer system, desktop computer, laptop, notebook, or netbook computer, mainframe computer system, handheld computer, workstation, network computer, a camera, a set top box, a mobile device, network device, internet appliance, PDA, wireless phones, pagers, a consumer device, video game console, handheld video game device, application server, storage device, a peripheral device such as a switch, modem, router, or other type of computing or electronic device.

In the illustrated embodiment, computer system 500 includes one or more processors 510 coupled to a system memory 520 via an input/output (I/O) interface 530. Computer system 500 further includes a network interface 540 coupled to I/O interface 530, and one or more input/output devices 550, such as cursor control device 560, keyboard 570, and display(s) 580. In some embodiments, it is contemplated that embodiments may be implemented using a single instance of computer system 500, while in other embodiments multiple such systems, or multiple nodes making up computer system 500, may be configured to host different portions or instances of embodiments. For example, in one embodiment some elements may be implemented via one or more nodes of computer system 500 that are distinct from those nodes implementing other elements.

In various embodiments, computer system 500 may be a uniprocessor system including one processor 510, or a multiprocessor system including several processors 510 (e.g., two, four, eight, or another suitable number). Processors 510 may be any suitable processor capable of executing instructions and may include one or more semiconductor(s) and/or transistors (e.g., electronic integrated circuits (ICs)). In such a context, processor-executable instructions may be electronically executable instructions. For example, in various embodiments, processors 510 may be general-purpose or embedded processors implementing any of a variety of instruction set architectures (ISAs), such as the x86, PowerPC, SPARC, or MIPS ISAs, or any other suitable ISA. In multiprocessor systems, each of processors 510 may commonly, but not necessarily, implement the same ISA.

In some embodiments, at least one processor 510 may be a graphics processing unit. A graphics processing unit or GPU may be considered a dedicated graphics-rendering device for a personal computer, workstation, game console or other computing or electronic device. Modern GPUs may be very efficient at manipulating and displaying computer graphics, and their highly parallel structure may make them more effective than typical CPUs for a range of complex graphical algorithms. For example, a graphics processor may implement a number of graphics primitive operations in a way that makes executing them much faster than drawing directly to the screen with a host central processing unit (CPU). In various embodiments, the image processing methods disclosed herein may, at least in part, be implemented by program instructions configured for execution on one of, or parallel execution on two or more of, such GPUs. The GPU(s) may implement one or more application programmer interfaces (APIs) that permit programmers to invoke the functionality of the GPU(s). Suitable GPUs may be commercially available from vendors such as NVIDIA Corporation, ATI Technologies (AMD), and others. In some embodiments, one or more computers may include multiple processors operating in parallel. A processor may be a central processing unit (CPU) or a special-purpose computing device, such as graphical processing unit (GPU), an integrated circuit or on-chip system, an application-specific integrated circuit (ASIC), a field-programmable gate array (FPGA), a complex programmable logic device (CPLD), or application-specific integrated circuits.

System memory 520 may be configured to store program instructions and/or data accessible by processor 510. In various embodiments, system memory 520 may be implemented using any suitable memory technology, such as static random-access memory (SRAM), synchronous dynamic RAM (SDRAM), nonvolatile/Flash-type memory, or any other type of memory. In the illustrated embodiment, program instructions and data implementing desired functions, such as those described in this disclosure, are shown stored within system memory 520 as program instructions 525 and data storage 535, respectively. In other embodiments, program instructions and/or data may be received, sent or stored upon different types of computer-accessible media or on similar media separate from system memory 520 or computer system 500. Generally speaking, a computer-accessible medium may include storage media or memory media such as magnetic or optical media, e.g., disk or CD/DVD-ROM coupled to computer system 500 via I/O interface 530. Program instructions and data stored via a computer-accessible medium may be transmitted by transmission media or signals such as electrical, electromagnetic, or digital signals, which may be conveyed via a communication medium such as a network and/or a wireless link, such as may be implemented via network interface 540.

In one embodiment, I/O interface 530 may be configured to coordinate I/O traffic between processor 510, system memory 520, and any peripheral devices in the device, including network interface 540 or other peripheral interfaces, such as input/output devices 550. In some embodiments, I/O interface 530 may perform any necessary protocol, timing or other data transformations to convert data signals from one component (e.g., system memory 520) into a format suitable for use by another component (e.g., processor 510). In some embodiments, I/O interface 530 may include support for devices attached through various types of peripheral buses, such as a variant of the Peripheral Component Interconnect (PCI) bus standard or the Universal Serial Bus (USB) standard, for example. In some embodiments, the function of I/O interface 530 may be split into two or more separate components, such as a north bridge and a south bridge, for example. In addition, in some embodiments some or all of the functionality of I/O interface 530, such as an interface to system memory 520, may be incorporated directly into processor 510.

Network interface 540 may be configured to allow data to be exchanged between computer system 500 and other devices attached to a network, such as other computer systems, or between nodes of computer system 500. In various embodiments, network interface 540 may support communication via wired or wireless general data networks, such as any suitable type of Ethernet network, for example, via telecommunications/telephony networks such as analog voice networks or digital fiber communications networks; via storage area networks such as Fibre Channel SANs, or via any other suitable type of network and/or protocol.

Input/output devices 550 may, in some embodiments, include one or more display terminals, cursor control devices (e.g., mouse), keyboards, keypads, touchpads, touchscreens, scanning devices, voice or optical recognition devices, or any other devices suitable for entering or retrieving data by one or more computer system 500. Multiple input/output devices 550 may be present in computer system 500 or may be distributed on various nodes of computer system 500. In some embodiments, similar input/output devices may be separate from computer system 500 and may interact with one or more nodes of computer system 500 through a wired or wireless connection, such as over network interface 540.

Those skilled in the art will appreciate that computer system 500 is merely illustrative and is not intended to limit the scope of the present disclosure. In particular, computer system 500 may also be connected to other devices that are not illustrated, or instead may operate as a stand-alone system. In addition, the functionality provided by the illustrated components may in some embodiments be combined in fewer components or distributed in additional components. Similarly, in some embodiments, the functionality of some of the illustrated components may not be provided and/or other additional functionality may be available.

It should be understood that the description and the drawings are not intended to limit the invention to the particular form disclosed, but to the contrary, the intention is to cover all modifications, equivalents, and alternatives falling within the spirit and scope of the present invention as defined by the appended claims. Further modifications and alternative embodiments of various aspects of the invention will be apparent to those skilled in the art in view of this description. Accordingly, this description and the drawings are to be construed as illustrative only and are for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed or omitted, and certain features of the invention may be utilized independently, all as would be apparent to one skilled in the art after having the benefit of this description of the invention. Changes may be made in the elements described herein without departing from the spirit and scope of the invention as described in the following claims. Headings used herein are for organizational purposes only and are not meant to be used to limit the scope of the description.

As used throughout this application, the word "may" is used in a permissive sense (i.e., meaning having the potential to), rather than the mandatory sense (i.e., meaning must). The words "include", "including", and "includes" and the like mean including, but not limited to. As used throughout this application, the singular forms "a," "an," and "the" include plural referents unless the content explicitly indicates otherwise. Thus, for example, reference to "an element" or "a element" includes a combination of two or more elements, notwithstanding use of other terms and phrases for one or more elements, such as "one or more." The term "or" is, unless indicated otherwise, non-exclusive, i.e., encompassing both "and" and "or." Terms describing conditional relationships, e.g., "in response to X, Y," "upon X, Y,", "if X, Y," "when X, Y," and the like, encompass causal relationships in which the antecedent is a necessary causal condition, the antecedent is a sufficient causal condition, or the antecedent is a contributory causal condition of the consequent, e.g., "state X occurs upon condition Y obtaining" is generic to "X occurs solely upon Y" and "X occurs upon Y and Z." Such conditional relationships are not limited to consequences that instantly follow the antecedent obtaining, as some consequences may be delayed, and in conditional statements, antecedents are connected to their consequents, e.g., the antecedent is relevant to the likelihood of the consequent occurring. Further, unless otherwise indicated, statements that one value or action is "based on" another condition or value encompass both instances in which the condition or value is the sole factor and instances in which the condition or value is one factor among a plurality of factors. Unless otherwise indicated, statements that "each" instance of some collection have some property should not be read to exclude cases where some otherwise identical or similar members of a larger collection do not have the property, i.e., each does not necessarily mean each and every. Unless specifically stated otherwise, as apparent from the discussion, it is appreciated that throughout this specification discussions utilizing terms such as "processing," "computing," "calculating," "determining" or the like refer to actions or processes of a specific apparatus, such as a special purpose computer or a similar special purpose electronic processing/computing device.

What is claimed is:

1. An active fault detection system for a heating, ventilation, and air conditioning (HVAC) system, the active fault detection system comprising:

at least one processor; and memory storing instructions executable by the at least one processor, the instructions when executed cause the system to:

obtain system data related to operation of one or more components of the HVAC system;

determine a fault probability value based on the system data, the fault probability value indicating a probability of a fault in the HVAC system;

send a control signal to a component of the HVAC system to modify one or more control parameters of the component responsive to the fault probability value being within a fault probability threshold range, the probability threshold range having an upper and lower threshold values, the control signal configured to amplify behavior of the component;

update the determined fault probability based on updated system data resulting from modifying the one or more control parameters; and generate a service schedule responsive to the updated fault probability being above the upper threshold value.

2. The active fault detection system of claim 1, further comprising:

one or more sensors configured to generate output signals related to the operation of one or more components of the HVAC system, and wherein the instructions further cause the system to:

determine the system data based on the output signals.

3. The active fault detection system of claim 1, wherein the instructions further cause the system to:

identify the component of the HVAC based on the system data; and determine the one or more control parameters to modify based on the system data.

4. The active fault detection system of claim 1, wherein modifying the one or more control parameters of the component is temporary, and wherein the instructions further cause the system to return the one or more control parameters to a pre-modification state.

5. The active fault detection system of claim 1, wherein the instructions further cause the system to:

determine a control action to resolve the fault; and apply the control action to the HVAC system, and/or include the control action in the generated service schedule.

6. The active fault detection system of claim 1, wherein the HVAC system comprises a thermostat, and wherein the thermostat comprises the at least one processor and the memory storing instructions.

7. The active fault detection system of claim 1, wherein the instructions further cause the system to determine the fault probability based on occupancy information or energy consumption needs.

8. The active fault detection system of claim 1, wherein modifying the one or more control parameters comprises increasing or decreasing a compressor speed for a determined length of modification.

9. The active fault detection system of claim 1, wherein modifying the one or more control parameters comprises modulating a degrees of opening of an electronic expansion valve (EXV) to observe transient changes in superheat.

10. The active fault detection system of claim 1, wherein:

the active detection system is configured to reduce false fault predictions, and wherein sending the control signal is responsive to the fault probability being near the upper or lower probability thresholds.

11. A method for active fault detection in a heating, ventilation, and air conditioning (HVAC) system, the method being implemented using at least one processor, and memory storing instructions, the method comprising:

obtaining system data related to operation of one or more components of the HVAC system;

determining a fault probability value based on the system data, the fault probability value indicating a probability of a fault in the HVAC system;

sending a control signal to a component of the HVAC system to modify one or more control parameters of the component responsive to the fault probability value being within a fault probability threshold range, the probability threshold range having an upper and lower threshold values, the control signal configured to amplify behavior of the component;

updating the determined fault probability based on updated system data resulting from modifying the one or more control parameters; and generating a service schedule responsive to the updated fault probability being above the upper threshold value.

12. The method of claim 11, further comprising:

generating, with one or more sensors, output signals related to the operation of one or more components of the HVAC system; and determining the system data based on the output signals.

13. The method of claim 11, further comprising:

identifying the component of the HVAC based on the system data; and determining the one or more control parameters to modify based on the system data.

14. The method of claim 11, wherein modifying the one or more control parameters of the component is temporary, and wherein the method further comprises:

causing the system to return the one or more control parameters to a pre-modification state.

15. The method of claim 11, further comprising:

determining a control action to resolve the fault; and applying the control action to the HVAC system, and/or including the control action in the generated service schedule.

16. A non-transitory computer-readable storage medium storing program instructions, wherein the program instructions are computer-executable to implement:

obtaining system data related to operation of one or more components of a heating, ventilation, and air conditioning (HVAC) system;

determining a fault probability value based on the system data, the fault probability value indicating a probability of a fault in the HVAC system;

sending a control signal to a component of the HVAC system to modify one or more control parameters of the component responsive to the fault probability value being within a fault probability threshold range, the probability threshold range having an upper and lower threshold values, the control signal configured to amplify behavior of the component;

updating the determined fault probability based on updated system data resulting from modifying the one or more control parameters; and generating a service schedule responsive to the updated fault probability being above the upper threshold value.

17. The non-transitory computer-readable storage medium of claim 16, wherein the instructions are computer-executable to implement:

identifying the component of the HVAC based on the system data; and determining the one or more control parameters to modify based on the system data.

18. The non-transitory computer-readable storage medium of claim 16, wherein modifying the one or more control parameters of the component is temporary, and wherein the instructions further implement returning the one or more control parameters to a pre-modification state.

19. The non-transitory computer-readable storage medium of claim 16, wherein the instructions are computer-executable to implement:

determining a control action to resolve the fault; and applying the control action to the HVAC system, and/or including the control action in the generated service schedule.

* * * * *